US006144914A

United States Patent [19]

Davis et al.

[11] Patent Number: 6,144,914

[45] Date of Patent: Nov. 7, 2000

[54] CONFIGURABLE SPEED TIMING INTERRUPTS

[75] Inventors: Errol W. Davis, Neuenhain, Germany; Eric E. Sollenberger, Brimfield, Ill.

[73] Assignee: Caterpillar Inc., Peoria, Ill.

[21] Appl. No.: 09/276,575

[22] Filed: Mar. 25, 1999

[51] Int. Cl.[7] ..... F02D 41/26

[52] U.S. Cl. ..... 701/104; 701/105; 701/114

[58] Field of Search ..... 701/103–105, 701/114; 123/480

[56] References Cited

U.S. PATENT DOCUMENTS

| | | | |
|---|---|---|---|
| 4,819,173 | 4/1989 | Brauninger | 701/114 |
| 4,931,940 | 6/1990 | Ogawa et al. | 701/101 |
| 4,970,668 | 11/1990 | Satoh et al. | 701/102 |
| 5,095,437 | 3/1992 | Shibata et al. | 701/102 |
| 5,400,268 | 3/1995 | Katsuda et al. | 700/304 |
| 6,029,630 | 2/2000 | Toyohara et al. | 123/480 |

FOREIGN PATENT DOCUMENTS

| | | |
|---|---|---|
| 0 602 692 A2 | 6/1994 | European Pat. Off. . |
| 43 13 331 A1 | 10/1994 | Germany . |
| 1-116270 | 5/1989 | Japan . |

*Primary Examiner*—Andrew M. Dolinar
*Attorney, Agent, or Firm*—R. Carl Wilbur

[57] ABSTRACT

An engine controller including programmable interrupt means connected with an engine speed sensor permits the controller to have configurable speed timing interrupts.

11 Claims, 3 Drawing Sheets

Fig. 3

| CYL. NUMBER | CRANK TOOTH NUMBER | CAM TOOTH NUMBER | ENGINE DEGREES |
|---|---|---|---|
| | 28 | 2 | 80 |
| | | | 85 |
| CYL. 3 MARKER | 29 | | 90 |
| | | | 95 |
| | 30 | 3 | 100 |
| | | | 105 |
| 300 | 31 | | 110 |
| | | | 115 |
| | 32 | 4 | 120 |
| | | | 125 |
| | 33 | | 130 |
| | | | 135 |
| | 34 | 5 | 140 |
| | | | 145 |
| | 35 | | 150 |
| | | | 155 |
| | 36 | 6 | 160 |
| | | | 165 |
| | 37 | | 170 |
| | | | 175 |
| #3 TDC | 38 | 7 | 180 |
| | | | 185 |
| CPU Interrupt Disabled | 39 | | 190 |
| | | | 195 |
| CPU Interrupt Disabled | 40 | 8 | 200 |
| | | | 205 |
| CPU Interrupt Disabled | 41 | | 210 |
| | | | 215 |
| CPU Interrupt Disabled | 42 | 9 | 220 |
| | | | 225 |
| CPU Interrupt Disabled | 43 | | 230 |
| | | | 235 |
| CPU Interrupt Disabled | 44 | 10 | 240 |
| | | | 245 |
| CPU Interrupt Disabled | 45 | | 250 |
| | | | 255 |
| | 46 | 11 | 260 |
| | | | 265 |
| CYL. 4 MARKER | 47 | | 270 |
| | | | 275 |
| | 48 | 12 | 280 |
| | | | |

CONFIGURABLE SPEED TIMING INTERRUPTS

TECHNICAL FIELD

The present invention relates generally to an electronic engine controller and, more specifically, to an engine controller capable of producing fuel delivery signals with fewer controller interrupts.

BACKGROUND ART

Electronic engine controllers are known in the art. Typically, such controllers are connected with various engine parameter sensors that produce engine parameter signals. Examples of typical engine parameter sensors include an engine speed sensor, an engine temperature sensor, a transmission speed sensor, a throttle position sensor, a brake position sensor, and a clutch position sensor, among others. The electronic controller inputs those sensor signals and produces a fuel delivery signal as a function of the values of those inputs. One prior art engine controller is the ADEM III controller produced by the assignee of the present patent.

Although prior art systems generally work satisfactorily, some have drawbacks. One such drawback is the microprocessor utilization required to sense engine speed, calculate an appropriate fuel delivery signal, and deliver the fuel delivery signal at the correct time. As is known to those skilled in the art, an engine speed sensor is typically used to sense the angular position of the engine, which in turn determines the appropriate time to issue a fuel delivery signal. Those engine speed sensors are typically proximity sensors associated with a rotating engine gear and have an output signal that varies as a function of gear teeth passing adjacent the sensor. Typically, an engine controller will produce an interrupt signal when each of the gear teeth pass the sensor. During that interrupt, the engine controller will typically calculate various values including: engine speed based on the elapsed time between adjacent engine gear teeth; fuel injection quantity; and fuel injection timing, among others. As will be appreciated by those skilled in the art, the microprocessor requires a certain amount of time to complete these calculations. As the engine speed increases, the number and rate of the interrupts will increase. There will be a maximum engine speed, above which the controller will be unable to perform the necessary calculations during the time period between passing teeth.

It would be preferable to have a system that could reduce the number of interrupts required to accurately control fuel delivery to the engine without causing engine performance or economy to suffer.

BRIEF DESCRIPTION OF THE DRAWINGS

FIG. 3 is a tabular example of the relationship between a marker tooth for certain cylinders, gear teeth and engine angle.

DISCLOSURE OF THE INVENTION

In one aspect of the present invention an engine control for use with an internal combustion engine is disclosed. The engine control preferably includes an engine controller connected to an engine speed sensor. The controller produces interrupts and disables interrupts as a function of a signal from said engine speed sensor.

These and other aspects and advantages of the present invention will become apparent to those skilled in the art upon reading the following specification in conjunction with the drawings and appended claims.

BEST MODE FOR CARRYING OUT THE INVENTION

A best mode embodiment of the present invention is described herein. However, the invention is not limited to this single embodiment, but instead includes all other alternative embodiments that fall within the scope of the appended claims.

Figure 1:
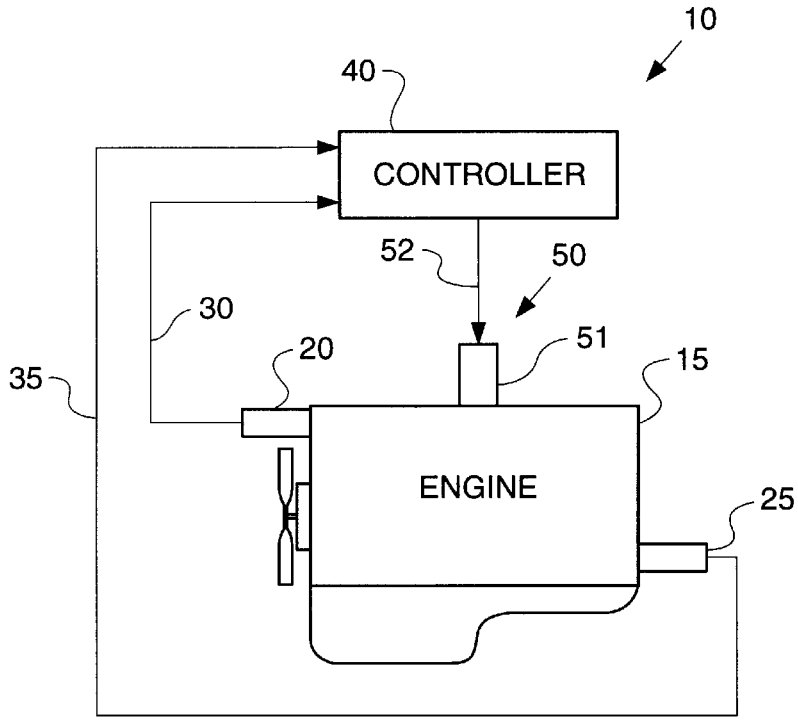
FIG. 1 is a block diagram of an engine control system practicing an embodiment of the present invention.

Referring first to FIG. 1, a system level block diagram of an engine control system 10 associated with a preferred embodiment of the invention is shown. Included in the engine control system 10 is an internal combustion engine 15, which in a preferred embodiment comprises a compression ignition engine. A first and second engine speed sensor 20, 25 are associated with the engine and produce a first and second output signal on electrical connectors 30, 35 respectively, which in turn are inputs to a controller 40. In a preferred embodiment, there are two engine speed sensors 20, 25, but in some embodiments or applications it may be preferable to include only a single engine speed sensor in the engine control system 10. The present invention is not limited to the use of two or more engine speed sensors. To the contrary, the present invention may be utilized in connection with an engine control system having a single engine speed sensor. In a preferred embodiment the engine speed sensors 20, 25 are magneto reluctance type proximity sensors that vary an output signal as a function of a gear tooth passing adjacent the sensor. For example, in a preferred embodiment, the first engine speed sensor 20 is associated with a cam shaft gear (not shown) and the second speed sensor 25 is associated with a crankshaft gear (not shown). As the engine rotates, the gear teeth of the respective gears pass adjacent the proximity sensors and the sensor varies the output signal on the respective electrical connectors 30, 35 that are inputs to the controller 40.

As will be apparent to those skilled in the art, the controller 40 shown in FIG. 1 includes a microcontroller 110 or microprocessor connected to related circuitry through appropriate data and address busses. Also included is appropriate signal conditioning, filtering and Input/Output circuitry to process both inputs from external sensors and devices, and outputs from the controller. Such circuits are known to those skilled in the art and can readily and easily be created by those skilled in the art. As shown in FIG. 1, the controller 40 is connected with fuel delivery means 50, which in a preferred embodiment is a single fuel injector 51 or a plurality of fuel injectors, one associated with each cylinder. The controller issues fuel delivery signals over connector 52 that cause the fuel delivery means to inject fuel into a specific engine cylinder at a specific time and for a specific duration.

Figure 2:
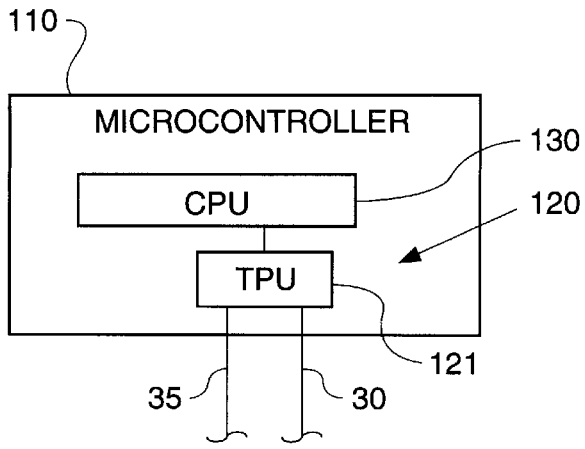
FIG. 2 is a block diagram of certain functional parts of an engine controller practicing an embodiment of the present invention.

Referring now to FIG. 2, a diagram is shown of relevant functional blocks included in a microcontroller 110. Many suitable microcontrollers include functional blocks that perform the functions shown in FIG. 2. In a preferred embodiment, a Motorola microcontroller from the 68336 family is used. However, other microcontrollers employing similar functionality or microprocessors joined with external circuitry to perform such functionality may be used, and such devices may nevertheless fall within the scope of the present invention as defined by the appended claims. Those skilled in the art could readily and easily substitute alternative microcontrollers, microprocessors, or microprocessors and external circuitry having similar overall functionality, for the microcontroller used in the preferred embodiment.

As shown in FIG. 2, the microcontroller preferably includes a programmable interrupt generator 120. In a preferred embodiment, the programmable interrupt generator includes a time processor unit 121 (hereinafter referred to as a "TPU"). The TPU is a functional block of the specific microcontroller used in a preferred embodiment of the present invention. However, other known equivalents could be substituted for the TPU including discrete circuitry or other integrated circuits performing the same function. The TPU 121 receives inputs from the first and second engine speed sensors 20, 25 over the electrical connectors 30, 35. The TPU 121 is preferably a programmable feature of the microprocessor that produces at least one output to a central processing unit ("CPU") 130. The TPU generates an interrupt signal as a function of the inputs on lines 30, 35 as a result of software programming downloaded into the TPU (described in more detail below). Once the CPU 130 receives the interrupt request, it causes the microprocessor to interrupt the software operation it is then performing and perform the software routine associated with the interrupt. Once the interrupt routine is performed then software control returns to the previous software operation. As will be discussed in more detail below, the interrupts driven by the first and second engine speed sensors cause the microprocessor to calculate fuel injection timing and duration based on various sensor inputs. These interrupts can consume a significant amount of microprocessor capacity, especially when the engine is running at relatively high speeds. To decrease the total microprocessor time devoted to the task of calculating a fuel delivery signal and delivering the signal at the appropriate time, the present invention reduces the number of times the microprocessor must perform this calculation for each engine cylinder. Alternatively, as will be apparent to those skilled in the art, an embodiment of the present invention could increase the accuracy of fuel injection timing or other events by increasing the number of teeth on the crankshaft or camshaft. The increased number of teeth would ordinarily generate additional interrupts and require additional microprocessor capacity. However, using an embodiment of the present invention would permit the increased accuracy without increasing microprocessor utilization.

As shown in FIG. 3, there is a specific tooth on either the cam shaft gear or a flywheel gear associated with each engine cylinder that is generically referred to as the marker tooth. As is known to those skilled in the art, fuel injection timing generally refers to the piston position in the cylinder where fuel is injected, and is generally referenced as degrees of crankshaft position before or after the piston reaches top dead center ("TDC"). The fuel injection timing can influence the power output and emissions of the engine, among other things. The optimal fuel injection timing will depend on a variety of factors, including control objectives and engine speed, among other factors.

In a preferred embodiment, the marker tooth is selected as a predetermined number of teeth (i.e. a predetermined crankshaft angle) prior to TDC for that cylinder. When the TPU 121 senses a marker tooth for a particular cylinder, it uses various sensor values that are stored in memory or read directly from a sensor to calculate the fuel injection timing and duration for that cylinder. The fuel injection timing calculation will be a crankshaft angle, which is then converted into a time before or after a specific gear tooth. Then, when the speed sensor signal on a connector 30, 35 corresponds to that specific gear tooth the TPU 121 generates an interrupt signal that causes the microcontroller 110 to issue an injection signal to the fuel injector associated with that cylinder. In a preferred embodiment of the present invention, once the microcontroller 110 has issued a fuel injection signal for that cylinder, no fuel will be injected into the next engine cylinder until after the next marker tooth is detected. Thus, the microcontroller 110 need not perform a fuel injection calculation until sensing the next marker tooth. In a preferred embodiment of the present invention, the TPU 121 will not generate another interrupt until it senses the next marker tooth.

For example, FIG. 3 shows a representative table of the relationship between a marker tooth, crankshaft teeth, camshaft teeth and engine angle for two cylinders of an engine practicing a preferred embodiment of the present invention. As shown in the figure, crankshaft tooth 29 represents the cylinder 3 marker tooth 300. Once the TPU 121 senses the marker tooth 300 it generates an interrupt causing the microcontroller 110 to calculate fuel injection timing and duration. The beginning of fuel injection associated with the fuel injection timing calculation is then translated into a time with respect to a specific crankshaft gear tooth; for example, in one calculation the beginning of injection might be at tooth 37. The TPU 121 will continue to monitor the timing signals on connectors 30, 35 until it identifies the beginning of injection tooth 37 and then issues an interrupt to the CPU 130 to cause the microcontroller 110 to issue a fuel injection signal to a fuel injector 51 associated with cylinder 3. Because the microcontroller 110 will not have to issue a fuel injection signal to the next cylinder prior to the marker tooth associated with that cylinder, the present invention disables all interrupts associated with one of the first or second speed sensors until it senses the next marker tooth. In a preferred embodiment, the interrupts associated with the second sensor (the sensor associated with the crankshaft gear) are disabled. Although a preferred embodiment disables the interrupts of a single sensor, those skilled in the art will recognize that the embodiment of the present invention could readily and easily disable both sensors. As shown in the example in FIG. 3, the present invention would ignore all interrupts for crankshaft teeth 39 until 45. In this manner, the microcontroller is not required to process an interrupt for every crankshaft tooth and therefore decreases the microcontroller utilization required to perform fuel injection.

Figure 4:
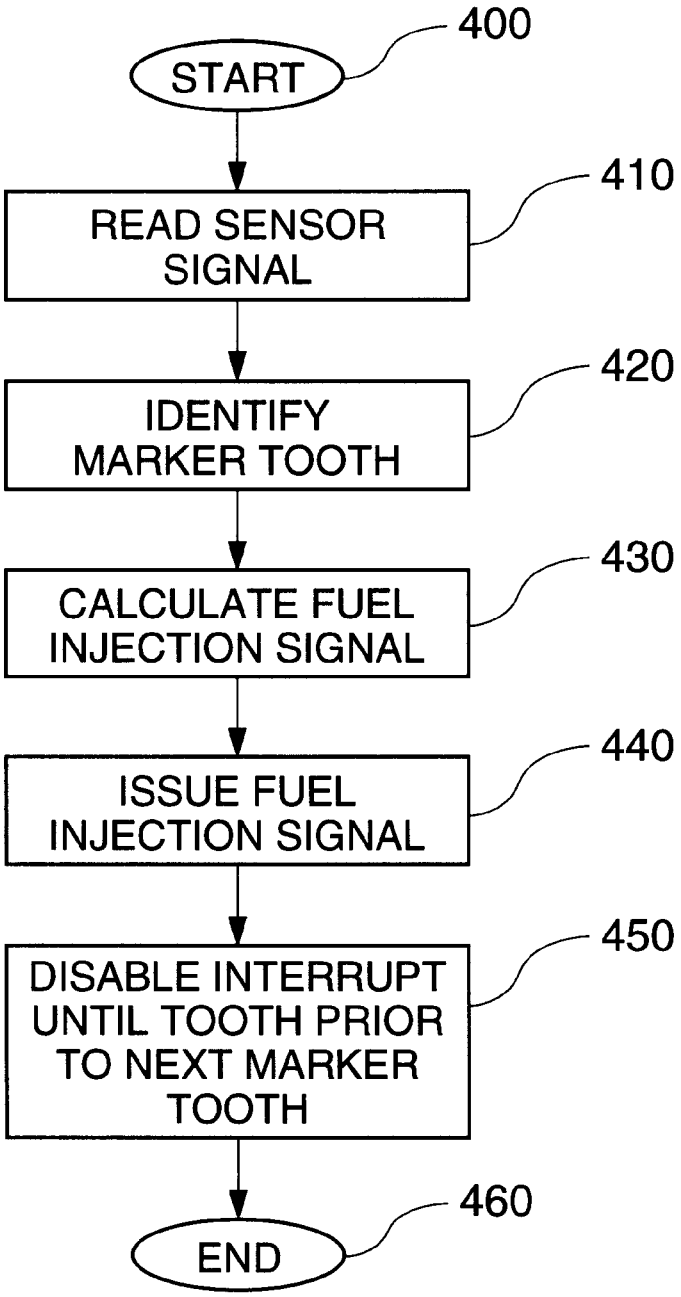
FIG. 4 is a flowchart of software used in connection with a preferred embodiment of the present invention.

Referring now to FIG. 4, a flowchart of the software performed by the TPU 121 in connection with a preferred embodiment is shown. Those skilled in the art can readily and easily construct the software code associated with a specific microcontroller TPU or the circuitry associated with a microprocessor from this flowchart. The flowchart generally shows the manner in which an embodiment of the present invention increases the overall microcontroller capacity by disabling certain interrupts and thereby decreasing the microprocessor utilization required to perform fuel injection.

The program begins in block 400 and passes to block 410. In block 410 the TPU reads signals from the first or second engine speed sensor 20, 25 over an electrical connector 30, 35. In block 420, when the TPU identifies the marker tooth associated with a specific cylinder it issues an interrupt signal to the interrupt controller 130 which causes the microcontroller to calculate a fuel injection signal (block 430). The TPU continues to issue interrupts upon sensing each subsequent tooth until after the microcontroller issues a fuel inject signal. In block 440, the microcontroller issues a fuel inject signal upon sensing the tooth corresponding to the beginning of injection, as determined by the calculated fuel injection signal. After issuing the fuel injection signal, the TPU does not issue interrupts until it senses the tooth immediately preceding the next marker tooth.

As can be appreciated by those skilled in the art, real time control of engines requires real time control calculations. As the number of calculations increases, it is either necessary to use a more powerful and more expensive microcontroller or microprocessor, or find ways to reduce the complexity of the calculations or the number of calculations. An embodiment of the present invention decreases the number of calculations driven by a TPU 121 generated interrupt resulting from sensing a gear tooth. Thus, an embodiment of the present invention will permit a microprocessor to be used in the same engine, but at increased engine speeds, then would the same microprocessor practicing controls known in the prior art. Alternatively, the present embodiment could be used to increase the accuracy of fuel injection events without increasing microprocessor utilization by increasing the number of teeth on the crankshaft or camshaft gear.

What is claimed is:

1. A method of generating a fuel injection signal in a compression ignition engine, said engine being controlled by a microcontroller, having a position sensor associated with a gear on the engine and producing signals as a function of gear teeth passing adjacent said sensor, said signals being received by said microcontroller, said gear including a marker tooth associated with each engine cylinder, the method comprising:

interrupting said a central processing unit of said microcontroller in response to receiving a signal corresponding to said marker tooth;

calculating an injection time and duration is response to said step of interrupting, said injection time corresponding to a gear tooth; and disabling and enabling interrupts as a function of said calculated injection time.

2. The method according to claim 1, wherein said position sensor is associated with a rotating gear on said engine, the rotational position of said gear being a function of the position of individual engine pistons in relationship to top dead center of the cylinder.

3. The method according to claim 2, wherein the rotating gear includes the crankshaft gear.

4. The method according to claim 1, wherein said interrupts are disabled after said injection time until the tooth immediately preceding the nest marker tooth.

5. A method of disabling controller interrupts, said controller associated with an electronically controlled, fuel injected internal combustion engine, said method comprising:

sensing a first rotational position of the engine, said first position associated with an injection event for a specific cylinder of said engine;

sensing an engine parameter;

calculating a fuel injection time, said fuel injection time being associated with a second rotational position of the engine;

sensing said second rotational position and issuing a fuel injection signal;

enabling controller interrupts between said first and second positions and disabling controller interrupts for a variable duration subsequent to sensing said second rotational position.

6. A control for an electronically controlled internal combustion engine, said engine having a plurality of engine cylinders, said engine having a plurality of first positions associated with each of said engine cylinders, comprising:

a gear associated with said engine, the rotational position of said gear being a function of the rotational position of said engine;

a position sensor, said position sensor producing a position signal as a function of the position of the gear;

a controller receiving said position signal, and producing an interrupt in response to receiving a signal indicative of a first position; and said controller calculating an fuel injection time upon receiving said position signal indicative of said preselected engine position, said fuel injection time represented by a second position of said gear;

said controller terminating interrupts produced in response to said first position sensor signals after receiving a position signal indicative of said second position and restarting said interrupts upon receiving another first position signal.

7. The apparatus according to claim 6, wherein said gear comprises a crankshaft gear.

8. The apparatus according to claim 6, wherein said first position comprises a marker tooth.

9. The apparatus according to claim 7, wherein said sensor is associated with said crankshaft gear.

10. The apparatus according to claim 9, wherein said controller includes a time processing unit connected with said sensor, said time processing unit being connected with a central processing unit.

11. The apparatus according to claim 10, wherein said time processing unit generates interrupts as a function of said position sensor signals, said time processing unit does not generate interrupts in response to said position signals indicating an engine position between the second position and the first position on a following cylinder.

* * * * *